US005468155A

United States Patent [19]

Johnston

[11] Patent Number: 5,468,155

[45] Date of Patent: Nov. 21, 1995

[54] CONNECTOR ACCESSORY FOR SHIELD TERMINATION

[75] Inventor: Paul A. Johnston, Hawthorne, Calif.

[73] Assignee: Hughes Aircraft Company, Los Angeles, Calif.

[21] Appl. No.: 310,189

[22] Filed: Sep. 21, 1994

[51] Int. Cl.[6] ..... H01R 13/648

[52] U.S. Cl. ..... 439/98; 439/610

[58] Field of Search ..... 439/98, 610, 540.1; 174/78; 248/68.1; 211/26

[56] References Cited

U.S. PATENT DOCUMENTS

| | | | |
|---|---|---|---|
| 4,687,263 | 8/1987 | Cosmos et al. | 439/108 |
| 4,975,251 | 9/1990 | Hubbard | 248/68.1 |
| 5,035,652 | 7/1991 | Shibano | 439/610 |
| 5,241,135 | 8/1993 | Fetzer | 439/98 |

FOREIGN PATENT DOCUMENTS

| | | | |
|---|---|---|---|
| 4109863 | 10/1992 | Germany | 439/610 |
| 122578 | 5/1989 | Japan | 439/610 |

*Primary Examiner*—Gary F. Paumen
*Attorney, Agent, or Firm*—Elizabeth E. Leitereg; Terje Gudmestad; W. K. Denson-Low

[57] ABSTRACT

An accessory for shield termination of a shielded cable having a shielding braid surrounding a plurality of insulated conductors coupled to a connector includes a generally L-shaped bracket having a generally U-shaped portion with integrally formed first and second fingers extending therefrom. A clamping bar secures the shielding braid to the U-shaped portion of said bracket, and fasteners secure an integral flange on the connector to each of the fingers to provide a conductive path between the braid and the connector.

6 Claims, 2 Drawing Sheets

FIG. 4.
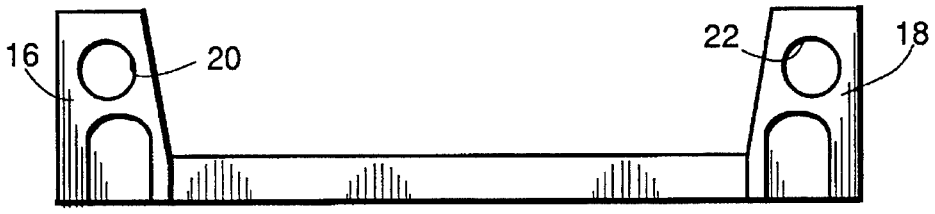
FIG. 5.
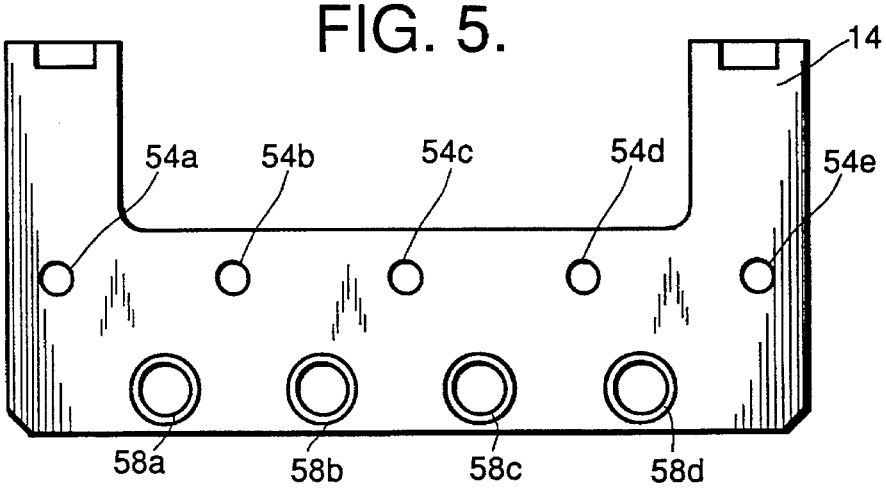
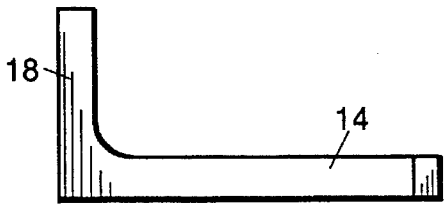
FIG. 6.
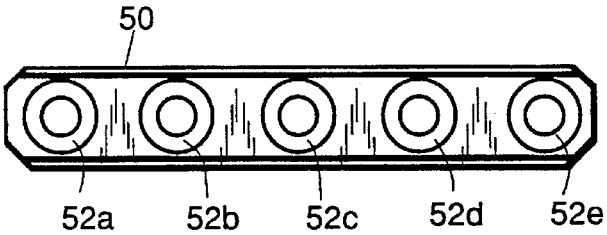
FIG. 7.
FIG. 8.
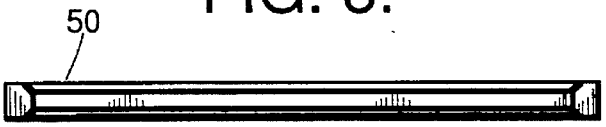
FIG. 9.
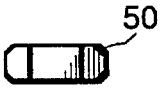

CONNECTOR ACCESSORY FOR SHIELD TERMINATION

TECHNICAL FIELD

This invention relates to a wiring harness connector accessory, and more particularly to an accessory for grounding the shielding braid of conductors connected with a multi-pin connector.

BACKGROUND ART

All satellites requires harnesses, each of which includes a shield that must be grounded. Indeed, there are hundreds of harness wire terminations that require grounding on each satellite.

One prior art technique for grounding the shield involves soldering wires to each shield in one of several configurations to terminate the shield. This approach results in a relatively high inductive path. Another technique involve encapsulating the shield in a conductive potting material which provides a conductive pack to the shield and which may then be grounded. Layers of protective coating must be built up over the area of the potting material and the coated assembly must be fully cured. Both of these prior art techniques require considerable process and rework time.

SUMMARY OF THE INVENTION

In accordance with the present invention a termination accessory for multi-pin connectors is provided which is particularly useful in satellite programs. The invention provides a low profile, reduced process time, ease of rework and a low inductive path to ground, all of which are highly desirable, particularly in satellites. The accessory includes a generally L-shaped bracket, preferably of nickel plated aluminum, which includes a pair of integral projecting fingers. The flange normally provided on a conventional rectangular connector housing is secured to the fingers by conventional fasteners, such as screws and nuts. A plurality of pairs of insulated conductors or cables are supported within the connector housing. A shielding braid surrounds each insulated twisted pair of conductors. A bar clamps each shielding braid to the bracket using suitable fasteners to effectively provide an electrical conducting path from each braid to the flange on the connector housing.

Groups of cables are held in place using teflon tiedown straps which surround the cables and extend through openings in the bracket. This method of retaining the harness wire, reduces strain on the contacts inside the connectors.

Final grounding of the shielding braid is accomplished by removing the nuts and fastening the two screws to suitable standoffs on the housing of the electrical unit requiring the harness.

BRIEF DESCRIPTION OF THE DRAWINGS

A more thorough understanding of the present invention may be had from the following detailed description that should be read with the drawings in which:

FIGS. 4, 5 and 6 are, respectively, top, side and rear elevation views of the bracket element of the accessory; and FIGS. 7, 8 and 9 are, respectively, top, front and side elevation views of the clamping bar element of the accessory.

DETAILED DESCRIPTION OF PREFERRED EMBODIMENT

Figure 1:
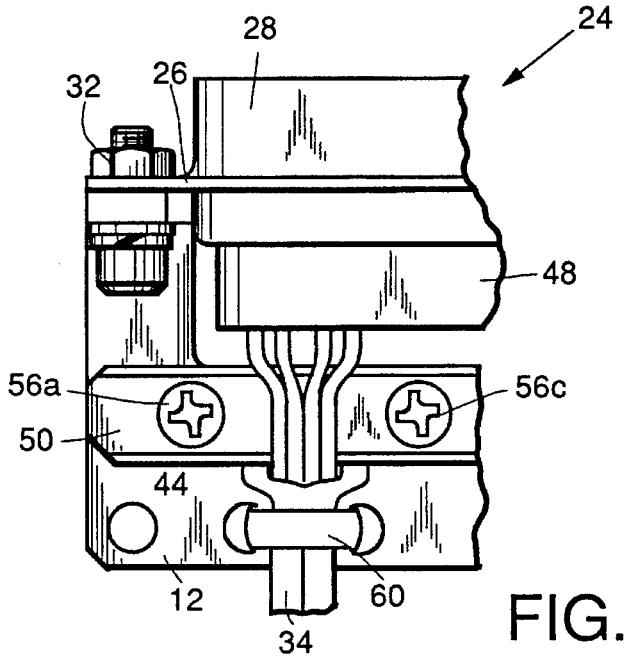
FIG. 1 is a partial top elevation view of the preferred embodiment of the accessory of the present invention.
Figure 2:
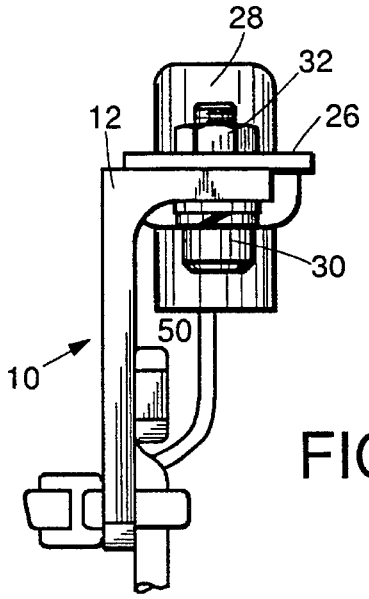
FIG. 2 is a side elevation view of the accessory.

Referring now to the drawings and initially to FIGS. 1 and 2, the shield terminating accessory of the present invention is generally designated 10. The accessory 10 includes a generally L-shaped bracket element 12 which is preferably made of aluminum and is nickel plated.

The bracket element 12, shown in greater detail in FIGS. 4, 5 and 6, includes a generally U-shaped portion 14, which has integral finger portions 16 and 18 which extend from and generally perpendicular to the portion 14. Each finger portion has a hole 20 and 22 respectively formed therein.

A conventional rectangular multi-pin connector is generally designated 24, and is provided with a flange 26 which extend from each side of a connector shell or housing 28. The flange 26 rests on fingers 16 and 18 and includes holes, not shown, that align with the holes 20 and 22 on the fingers, to receive a pair of socket head screws 30, only one of which is shown in FIG. 1. Each screw is received in a nut 32 for fastening or securing the connector to the accessory 10.

Figure 3:
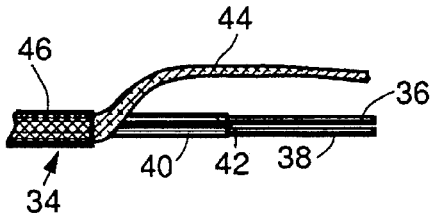
FIG. 3 shows a typical twisted pair of conductors.

A wiring harness for the satellite may include a plurality of twisted pairs of conductors or cables 34. As shown in FIG. 3 each cable includes a pair of conductors 36 and 38, within insulation 40 and 42 surrounded by a shielding braid 44 which in turn is covered by an outer insulation 46. The conductors terminate in a block 48 of insulating material which is housed within the shell 28 of the connector 24. The connector 24 is intended to mate with a suitable connector formed in an electrical unit, not shown.

The shielding braid 44 of each cable 34 is clamped to the bracket portion 14 by a clamping bar 50 shown in greater detail in FIGS. 7, 8, and 9. The clamping bar 50 is provided with a plurality of countersunk holes **52*a*–52*e* which align with threaded holes 54*a*–54*e* in bracket portion 14. The shielding braids 44 are clamped between the bar 50 and the bracket portion 14. The bar 50 is secured to the bracket portion by five flat head screws, only three of which are shown and are numbered 56*a*–56*c*, to provide a good electrical connection between the braids 44 and the bracket portion 14**.

The bracket portion 14 includes a plurality of holes **58*a*–58*d*. A suitable fastening mechanism, such as teflon tiedown strap 60 extends through a pair of the holes to secure the cables 34 to the accessory 10. This provides support for the wiring harness thereby reducing strain on the contacts inside the connector 24. Final grounding of the shielding braid is accomplished by removing the nuts 32 and fastening the two screw 30** to a suitable standoff on the grounded housing of the electrical unit to which the harness is to be connected.

While the forms of the invention herein disclosed are presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention.

What is claimed is:

1. An accessory for shield termination of a shielded cable having a shielding braid surrounding a plurality of insulated conductors coupled to a connector, said accessory comprising a generally L-shaped bracket having a generally U-shaped portion with integrally formed first and second fingers extending in a generally perpendicular direction thereto, a clamping bar securing said shielding braid to said U-shaped portion of said bracket, and a fastener securing said connector to each of said fingers.

2. The accessory defined in claim 1 wherein said connector is generally rectangular in shape and includes a housing of conductive material with an integral flange, said fasteners securing said flange to each of said fingers, said bracket being made of a conductive material providing an electrical path between said braid and said housing.

3. The accessory defined in claim 2 wherein said bracket is made of nickel plated aluminum.

4. A connector accessory for providing a ground path for the shielding braid which surrounds a plurality of insulated conductors coupled to a connector having an integral flange, said accessory comprising a generally L-shaped bracket having a generally U-shaped portion with integrally formed first and second fingers extending in a generally perpendicular direction therefrom, a clamping bar adapted to secure said shielding braid to said U-shaped portion of said bracket, each of said fingers adapted to be fastened to said flange for securing said conductor to said accessory and forming an electrically conductive path between said braid and said connector.

5. An accessory for a connector having a housing with an integral flange, an insulator block contained within said housing, said block supporting a plurality of conductors surrounded by a shielding braid, said accessory comprising a generally L-shaped bracket having a generally U-shaped portion with integrally formed first and second fingers extending therefrom in a generally perpendicular direction, a clamping bar adapted to secure said shielding braid to said U-shaped portion of said bracket, each of said fingers adapted to be fastened to said flange for securing to said accessory and providing a ground path from said shielding braid to said housing through said bracket.

6. The accessory of claim 5 wherein said U-shaped portion includes a plurality of holes for receiving tiedown straps for securing said conductors to said accessory to relieve strain on the connection between said conductors and said connector.

* * * * *

UNITED STATES PATENT AND TRADEMARK OFFICE
CERTIFICATE OF CORRECTION

PATENT NO. : 5,468,155

DATED : November 21, 1995

INVENTOR(S) : Paul A. Johnston

It is certified that error appears in the above-identified patent and that said Letters Patent is hereby corrected as shown below:

Column 1, line 4, before the heading "TECHNICAL FIELD," insert the paragraph: --This invention was made with Government support under Contract No. N00039-88-C-0300 awarded by the Navy. The Government has certain rights in this invention.--

Signed and Sealed this

Fifteenth Day of October, 1996

*Attest:*

Bruce Lehman

BRUCE LEHMAN

*Attesting Officer*

*Commissioner of Patents and Trademarks*